US010109136B2

(12) United States Patent
McGowan

(10) Patent No.: US 10,109,136 B2
(45) Date of Patent: Oct. 23, 2018

(54) SENSORY ENHANCEMENT SYSTEM FOR HANDHELD PROJECTILE DISPENSER

(71) Applicant: Gary Richard McGowan, Ellenwood, GA (US)

(72) Inventor: Gary Richard McGowan, Ellenwood, GA (US)

( * ) Notice: Subject to any disclaimer, the term of this patent is extended or adjusted under 35 U.S.C. 154(b) by 0 days.

(21) Appl. No.: 15/236,389

(22) Filed: Aug. 12, 2016

(65) Prior Publication Data

US 2017/0337762 A1 Nov. 23, 2017

Related U.S. Application Data

(60) Provisional application No. 62/204,436, filed on Aug. 12, 2015.

(51) Int. Cl.

| | |
|---|---|
| ***G07D 11/00*** | (2006.01) |
| ***F21V 33/00*** | (2006.01) |
| ***F21L 4/00*** | (2006.01) |
| ***F21V 23/04*** | (2006.01) |
| *F21Y 115/10* | (2016.01) |

(52) U.S. Cl.

CPC ..... *G07D 11/0021* (2013.01); *F21L 4/00* (2013.01); *F21V 23/045* (2013.01); *F21V 23/0414* (2013.01); *F21V 33/0004* (2013.01); *B65H 2701/1912* (2013.01); *F21Y 2115/10* (2016.08)

(58) Field of Classification Search

CPC ..... G07D 11/0021

USPC ..... 362/109, 86

See application file for complete search history.

(56) References Cited

U.S. PATENT DOCUMENTS

| | | | | |
|---|---|---|---|---|
| 6,068,157 | A * | 5/2000 | Kamiya | B65H 1/12 221/259 |
| 9,207,035 | B2 * | 12/2015 | Schexnayder | F41B 4/00 |
| 9,427,120 | B1 * | 8/2016 | Valentine | A47K 10/424 |
| 2003/0029741 | A1 * | 2/2003 | Wells | B65D 83/0805 206/223 |
| 2007/0095293 | A1 * | 5/2007 | Moulton | A01K 5/0114 119/51.01 |
| 2009/0302048 | A1 * | 12/2009 | Nobilet | A61F 15/002 221/1 |
| 2013/0312722 | A1 * | 11/2013 | Price | F41B 15/00 124/1 |
| 2014/0165985 | A1 * | 6/2014 | Bryngelson | A63H 37/00 124/82 |
| 2014/0217111 | A1 * | 8/2014 | Sampson | G07D 11/0021 221/1 |

* cited by examiner

*Primary Examiner* — Laura Tso

(74) *Attorney, Agent, or Firm* — Ming Chow; Sinorica, LLC

(57) ABSTRACT

The invention is a sensory enhancement system for a novelty item, such as a handheld projectile dispenser, used to dispense essentially planar object, such as small bills, paper, or other lightweight materials, such as coupons and the like. Furthermore, the sensory enhancement system includes visual enhancement features for a handheld projectile dispenser that provides rapid and wide dispersion of monetary bills and other dispensable materials. The sensory enhancement system may further compromise auditory enhancement features for additional sensory enhancement.

1 Claim, 9 Drawing Sheets

SENSORY ENHANCEMENT SYSTEM FOR HANDHELD PROJECTILE DISPENSER

REFERENCE TO RELATED APPLICATIONS

U.S. Non-Provisional application Ser. No. 14/164,119, filed on Jan. 24, 2014, was incorporated by reference in the U.S. Provisional Application No. 62/204,436 filed on Aug. 12, 2015, which is incorporated by reference herein. Applicant claims the earliest filing date.

TECHNICAL FIELD OF THE INVENTION

The technology described herein relates to the field of novelty entertainment and promotion. More specifically, the invention is a sensory enhancement system for a novelty item used to dispense essentially planar object, such as small bills, paper, or other lightweight materials, such as currency notes, novelty bills, large confetti, coupons and the like. Furthermore, this technology relates to audio/visual enhancement for a hand-held, manually activated and controlled projectile dispenser apparatus that provides rapid and wide dispersion of monetary bills and other dispensable materials.

BACKGROUND OF THE INVENTION

Apparatus for dispensing materials from rolls in a controlled fashion are known. For example, desktop adhesive tape dispensers provide a means for extending a piece of tape from a roll to the desired length and then severing the piece of tape so removed. Automatic Teller Machines (ATM) and similar apparatus have been developed to measure and dispense currency of particular denominations. The customer seeking to withdraw from an ATM controls the amount of currency to be dispensed based on their selection of a specific withdrawal amount, but this type of dispensing action is not within the user's control. These technologies do not contemplate or address the need for a hand-held dispensing apparatus for dispersing stacked currency bills or similarly shaped planar materials in a rapid-dispensing process that is visually and/or auditorily engaging, thus enhancing the novelty of the apparatus.

SUMMARY OF THE INVENTION

The invention comprises a sensory enhancement system for an apparatus which ejects from an orifice, by projectile means, dispensable materials such as paper money, individual pieces of paper, lightweight materials or flat, planar objects. The apparatus includes a storage compartment with an opening to load and subsequently dispenses its contents. The apparatus further includes a handle that allows the user to hold, control, point and manipulate the apparatus to activate the sensory enhancement system and dispense the contents of the storage compartment. The apparatus further includes a mechanism to concurrently actuate the sensory enhancing system and the dispensing of items from inside the apparatus. This mechanism may be attached to or be remotely located separate from the apparatus, allowing the sensory enhancement system and the dispensing action of the apparatus to be activated from a distance by the user.

In one embodiment, the invention comprises a base further including a dispensing slot, a storage compartment comprised of two side panels, a front panel, a rear panel and a lid; wherein the dispensing slot traverses the front panel and wherein the side panels are connected to each of the front panel and rear panel at an angle to form the storage compartment, the upper edges of the side front and rear panels forming an opening of the storage compartment. The storage compartment may further be subdivided into internal compartments, for example a tray for holding the dispensable materials. The base further includes an activatable dispensing element comprised of at least one movable dispensing element housed within the base, a motor assembly and a power source; wherein the at least one movable dispensing element, upon activation of the motor assembly, consecutively contacts and engages with the exposed surface of a bill from a stack of bills in the storage compartment and moves that bill, and subsequent bills with which it comes in contact, in a trajectory toward the dispensing slot such that one or more bills are simultaneously dispersed from the dispensing slot. The apparatus further comprises a handle with an actuation means that is manually controlled, such as a switch or a trigger for activating the motorized dispensing element; wherein engagement of the actuation means actuates an electrical circuit which initiates a flow of electricity that activates the motor and further initiates the movement of the motorized dispensing element.

The present invention teaches a handle with an actuation means that is manually controlled, such as a switch or a trigger for activating the sensory enhancement system; wherein engagement of the actuation means actuates an electrical circuit which initiates a passage of electricity that activates the lighting system causing the repetitive lighting of serially aligned light-emitting diodes that allows the sensory enhancement system to provide a flashing effect.

In various exemplary embodiments, the technology of the invention includes a flashing feature for a handheld projectile dispenser apparatus that is actuated by as a trigger means connected to or located on the handle of the apparatus. Alternatively, a switch is provided whereby engagement or depression of the switch located on the handle of the device actuates the lighting feature of the sensory enhancement. Another alternative embodiment features the remote activation of the lighting/dispensing functions using a wirelessly coupled remote device, thus allowing the user to enjoy the lighting/dispensing features without having to actually hold the apparatus or press the trigger.

The dispenser apparatus includes a movable dispensing element comprised of a roller, series of rollers, movable foot or drive belt which is in direct contact with a stack of bills or dispensable materials in the storage compartment of the base. The movable dispensing element has a tactile surface which allows it to engage in rapid sequence with the surface of the outermost bill (for example the lowermost bill in a configuration having the bills stacked above the movable dispensing element) in a stack of bills to be dispersed, and to move each of the bills contacted and engaged by the movable dispensing element in linear fashion along a trajectory from the receptacle to the dispensing slot of the base. In this manner, a large number of bills can be dispensed in rapid order, i.e., "rained" from the dispensing slot of the apparatus. This "raining" effect is illuminated by the lighting features of the sensory enhancement system, especially in low-light conditions where the apparatus is frequently used.

In certain embodiments, the invention comprises an electrical motor, which when actuated by closure of an electrical circuit, concurrently effectuates the lighting sequence of the sensory enhancement system and the movement of the movable dispensing means to eliminate the dispensed material from the device. In these embodiments, activation of the actuation means closes the electrical circuit, resulting in a flow of current to the lighting elements of the sensory enhancement system that generates the appealing flashing effect.

In an embodiment of the invention, the light-emitting elements may be selectively programmed to flash, as in the preferred embodiment, remain lit in unison for the entire duration of time the trigger is pressed, or randomly light.

In yet another embodiment, the invention provides a method of rapid-fire dispersion of coupons, promotional bills, advertisements, business cards and the like in a desired projectile direction as determined by the user.

According to another embodiment of the invention there is provided a method for visually enhancing the dispensing of currency bills and other planar dispensable materials by a user of handheld projectile dispenser according to the invention as is herein claimed.

DETAILED DESCRIPTION OF CERTAIN EMBODIMENTS

In preferred embodiments, the invention is used to enhance the sensory enjoyment of a handheld projectile dispenser used to distribute a stack of bills or other dispensable materials in a manner completely controlled and directed by the user. As used in this application, the terms "bills" or "dispensable materials" means currency bills, bank notes, coupons, fliers or other stacked pieces of thin material made of pliable material such as paper or plastic. The unique construction, design and function of the sensory enhancement system provides illumination for handheld projectile dispenser that dispenses bills rapidly in projectile fashion by aiming and pointing the dispensing slot of the apparatus in a desired direction, then actuating the dispensing means to provide a rapid and continuous release of bills in targeted fashion while the flashing effect of the sensory enhancement system enhances the experience for the user. For example, a power source may be engaged by activating a switch to initiate and sustain the flashing sequence until the power source is disengaged by releasing the trigger or deactivating an integral or wireless switch.

Figure 1:
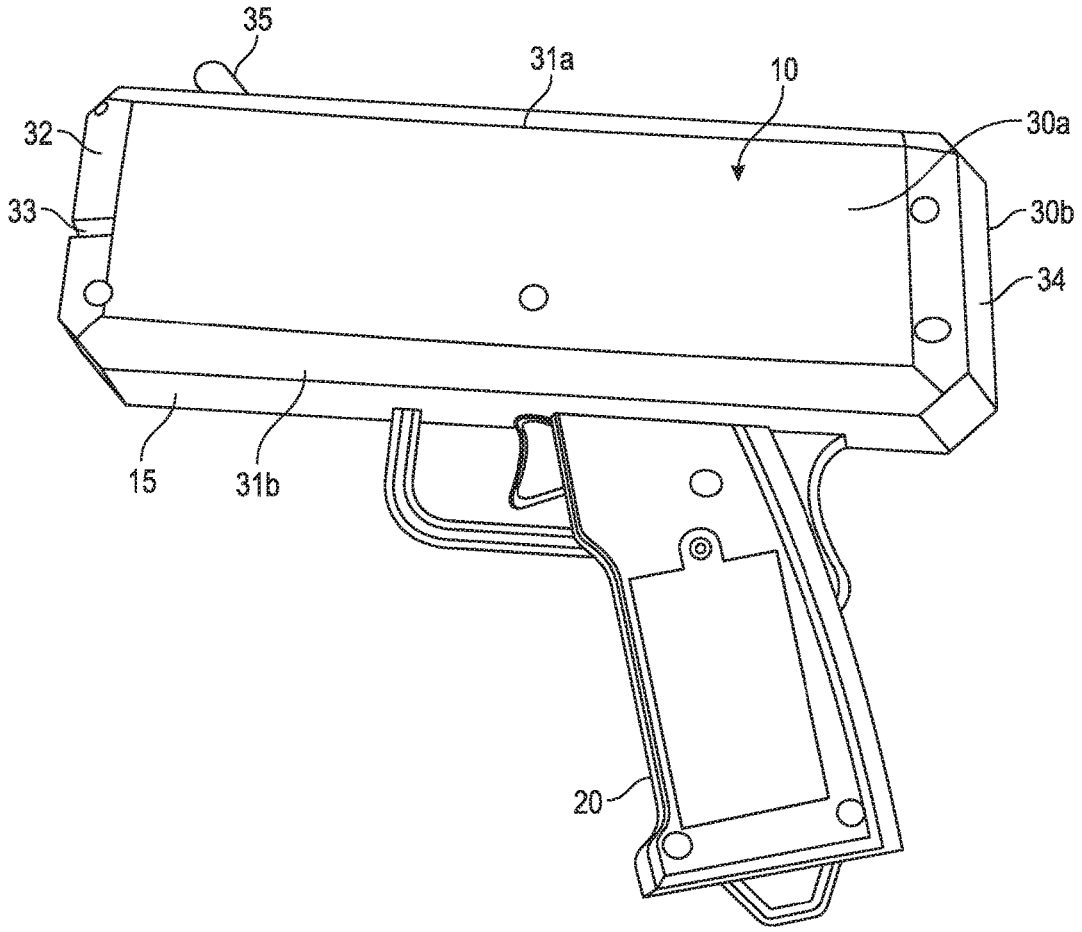
FIG. 1 is a side perspective view of a handheld projectile dispenser.
Figure 2:
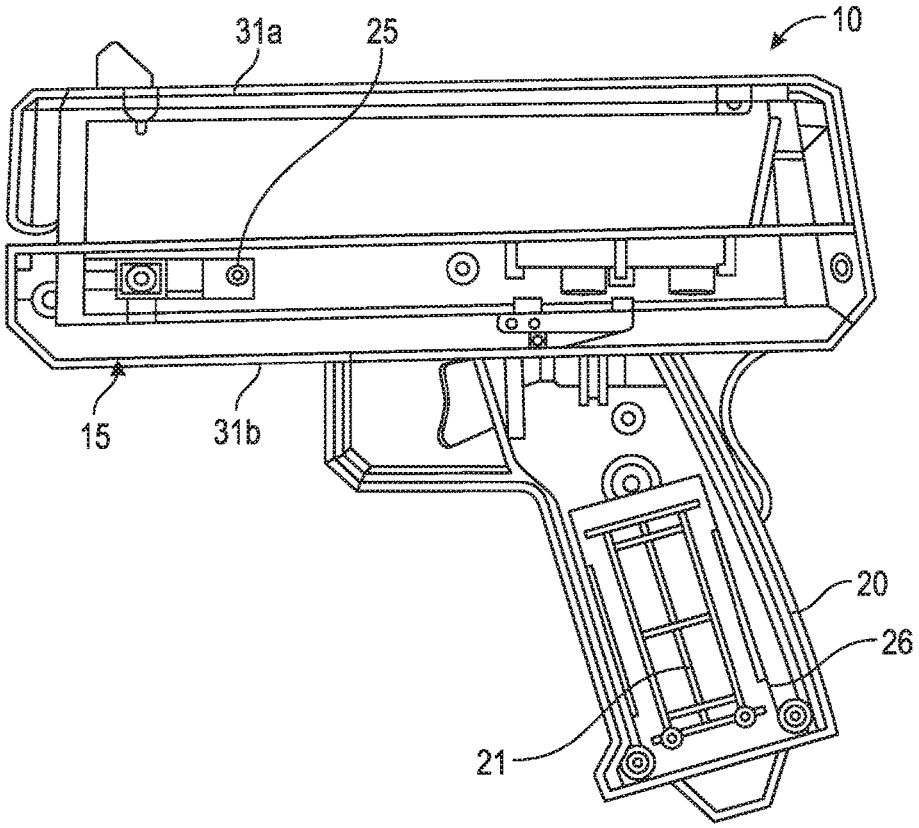
FIG. 2 is a cross-sectional view of a handheld projectile dispenser having a sensory enhancement system according to an embodiment of the invention.
Figure 3:
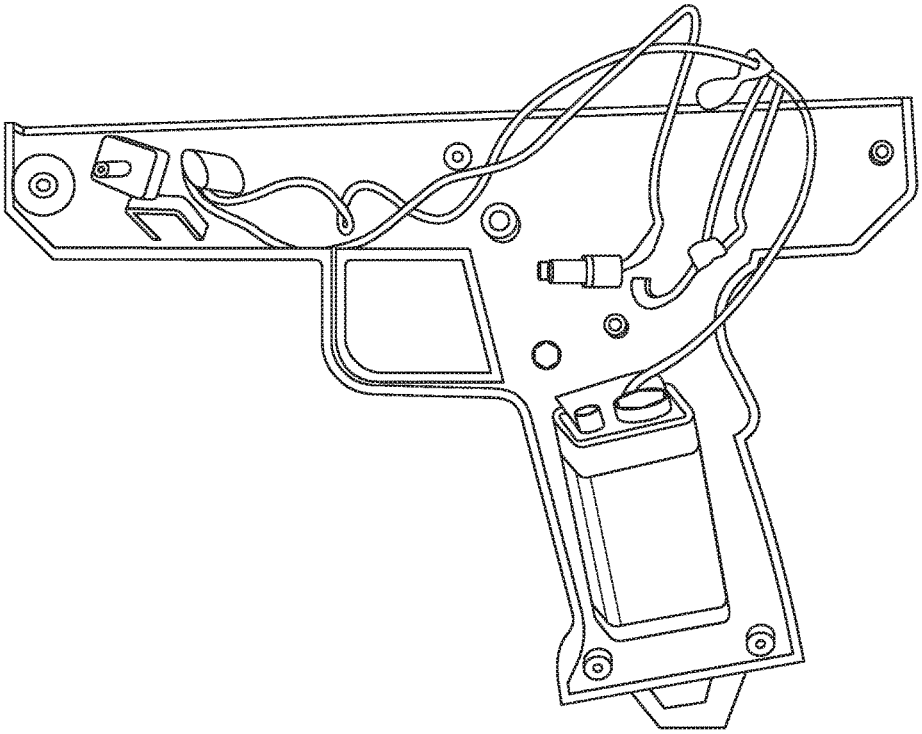
FIG. 3 is an environmental view of a handheld projectile dispenser having a sensory enhancement system according to an embodiment of the invention.

As seen in FIGS. 1-3, the body of the handheld projectile dispenser 10 may in certain desired embodiments be constructed of plastic or another lightweight material that allows for the passage of light from the seys of the invention. However, the apparatus may also be constructed of other materials, depending on the intended use of the handheld projectile dispenser and placement of the lighting elements of the seys. The base assembly 15 forms the bulk of the apparatus to which the handle 20 and other components are connected. One section of the base assembly 15 comprises a dispensing tray 25 for holding the bills that are to be dispensed from the handheld projectile dispenser. Also included in the base are a storage area for an electric motor and other parts of the movable dispensing assembly, such as multiple rollers, movable feet, or a drive belt.

The base 15 of the handheld projectile dispenser, as demonstrated in FIG. 1, may have the external configuration of an angled container, such as a rectangle or square, however in other embodiments the base is not limited as to its shape. As seen in FIG. 1, the base 15 is formed with two parallel and opposed side panels 30*a*, 30*b* with an upper panel 31*a* and lower panel 31*b* connecting the side panels 30*a*, 30*b* at the top and bottom edges, respectively. The container is further formed with a front panel 32 defined by an exposed front panel edge at the top thereof, and a horizontally disposed dispensing slot 33 across all or part of the width of the front panel 32. The dispensing slot 33 preferably is of dimensions suitable to accommodate the dispensable material, such as bills and paper money, to be passed through it in planar fashion without folding or wrinkling. The base 15 further includes a rear panel 34 and a lower panel 31*b* that forms the bottom and underside of the base 15. The side panels 30*a*, 30*b* and front panel 32 and rear panel 34 of the base 15 may be beveled, curved or otherwise shaped or designed for aesthetic purposes without compromising the functionality of the apparatus. The panels 30*a*, 30*b*, 3 of the base 15, the internal compartments and features and the handle element 20 may be molded or formed in segments that may be attached together by conventionally known fastening means, such as adhesive or screws, to form the apparatus.

Figure 7:
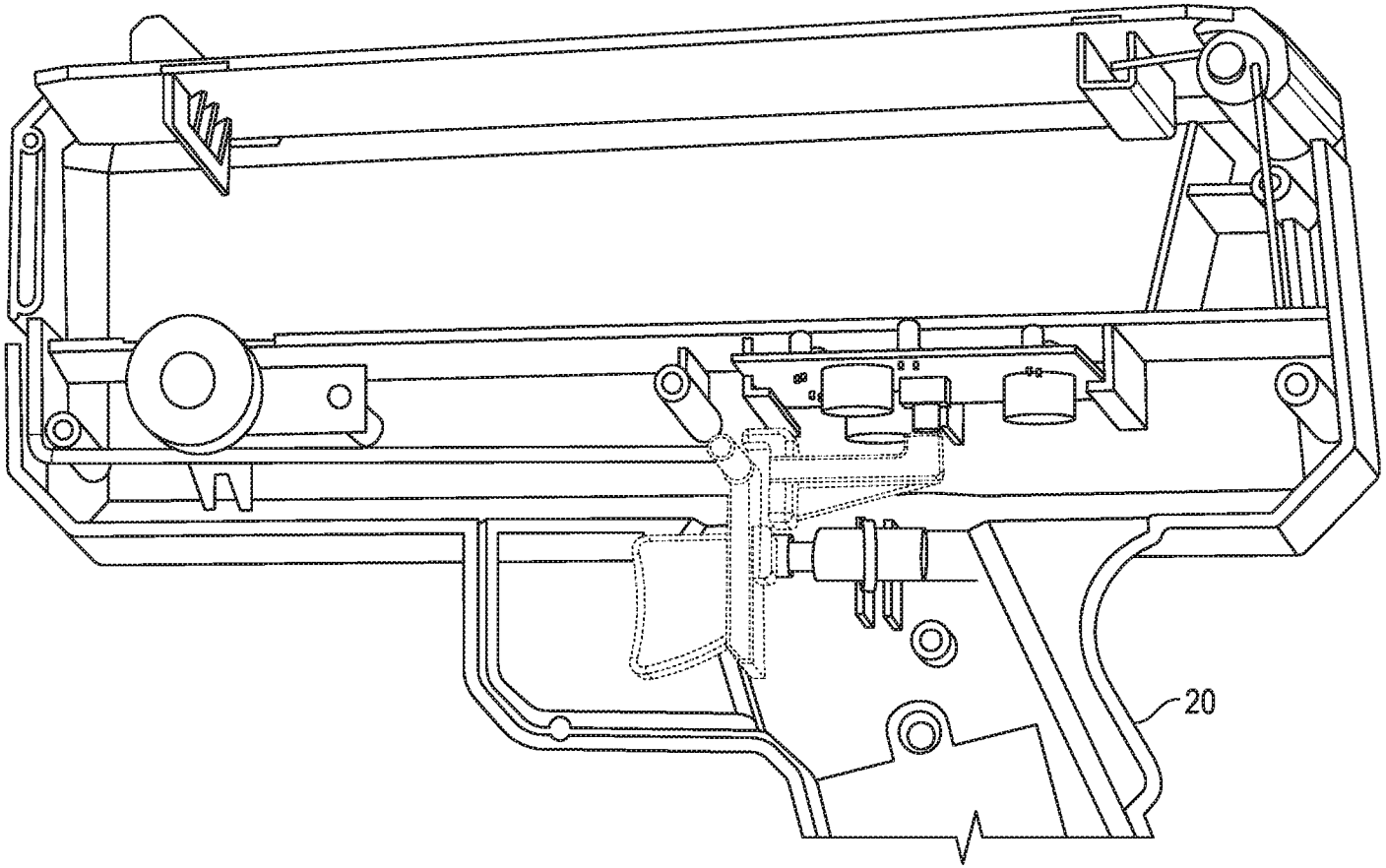
FIG. 7 is a highlighted environmental view of the trigger of the sensory enhancement system disposed in a handheld projectile dispenser according to preferred embodiment of the invention.
Figure 8:
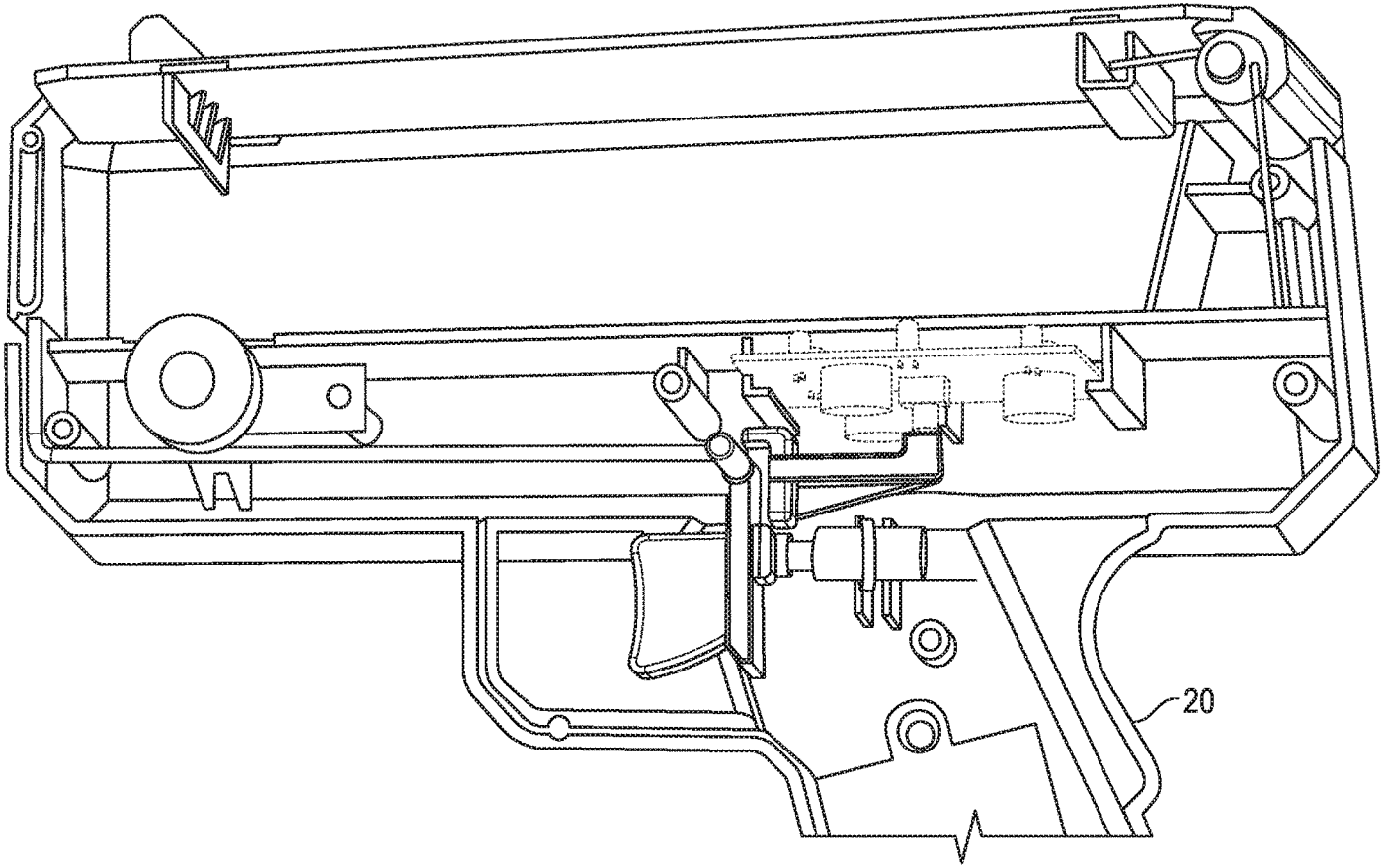
FIG. 8 is a highlighted environmental view of the system housing of the sensory enhancement system disposed in a handheld projectile dispenser according to preferred embodiment of the invention.
Figure 9:
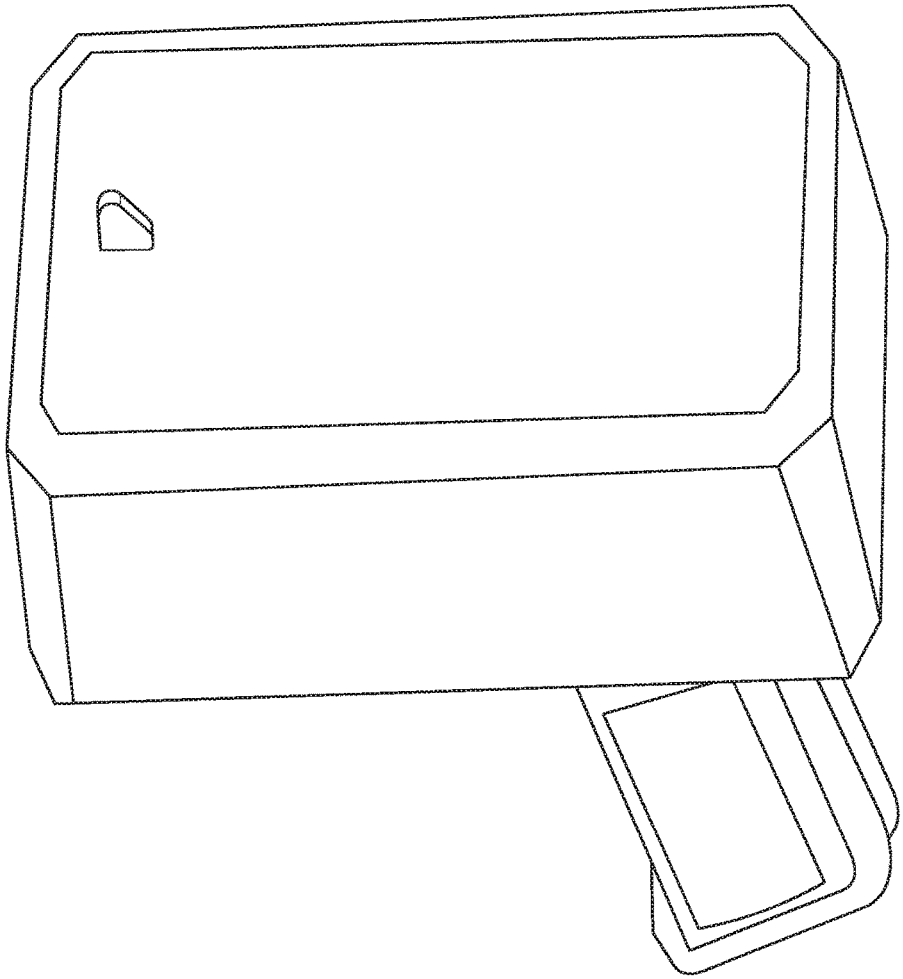
FIG. 9 is a top perspective view of a handheld projectile dispenser having a sensory enhancement system according to an embodiment of the invention.

As best seen in FIGS. 7-8, the sensory enhancement system of the preferred embodiment of the invention shows the handle 20 and the switching or actuation means for the sensory enhancement system configured as a trigger with a guide 45 configured around the switch 50. The handle 20 is connected as a detachable part to the underside of the base 15 by conventional means, for example adhesive, screws or as an integrally molded piece. It may also be molded together with the base 15. As seen in FIG. 2, a battery compartment is provided in the handle 20 via an opening integral thereto.

The upper panel 31*a* is also a lid that opens and closes to allow insertion of the bills or other materials to be dispensed may be removably attached to the top edge of the rear panel 34 of the base 15. Torsion springs may be included at the attached end of the upper panel 31*a* in order to add spring force to the closure mechanism. The hinges may be of conventional formations used as closure means. As further shown in FIG. 3, the exterior surface of lid 70 may further include a tab or grip 35 for moving upper panel 31*a* to and from the closed position.

In the switch and trigger-activated versions of the invention, two wires are attached to the positive and negative connector posts of the power source 21. The power source 21 may be configured as integral rechargeable battery pack that may be removed and plugged in to a wall outlet for recharging or simply replaceable batteries.

As shown in FIGS. 4-8, a trigger 40 may be incorporated in the handle 20. A battery (or batteries) 21 is installed into the handle 20 to be used as the device power source. Once the battery 21 is inserted into the battery compartment 26 at one end of the connecting post(s), then the cover of the battery compartment 26 is attached to secure the battery 21 in the handheld projectile dispenser.

Figure 4:
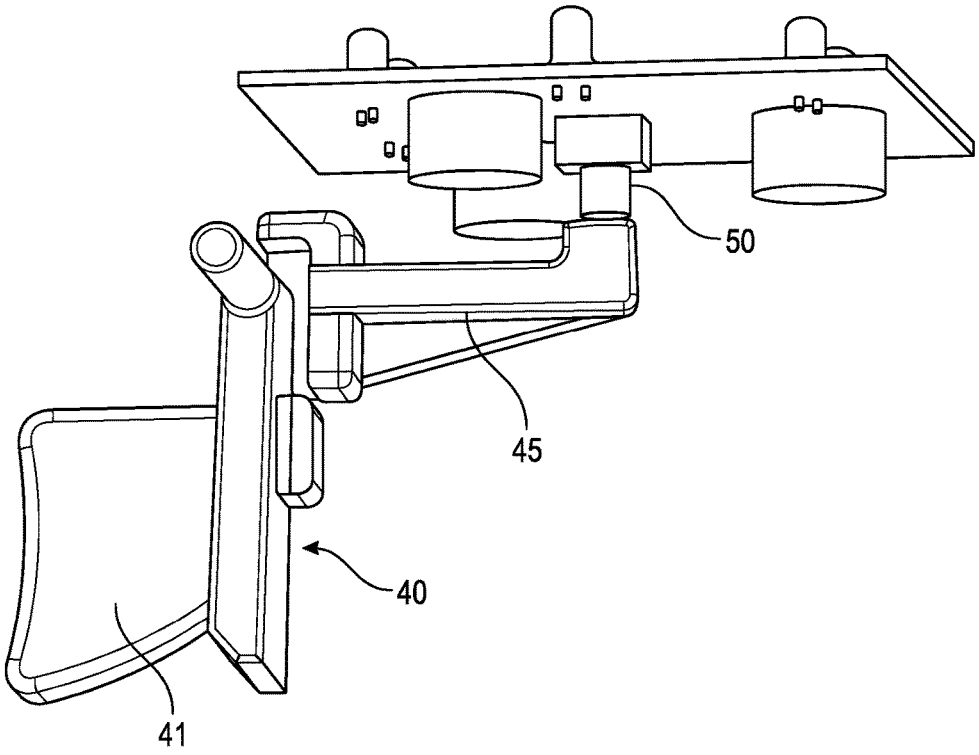
FIG. 4 is an exploded view of the trigger and system housing of the sensory enhancement system according to preferred embodiment of the invention.
Figure 5:
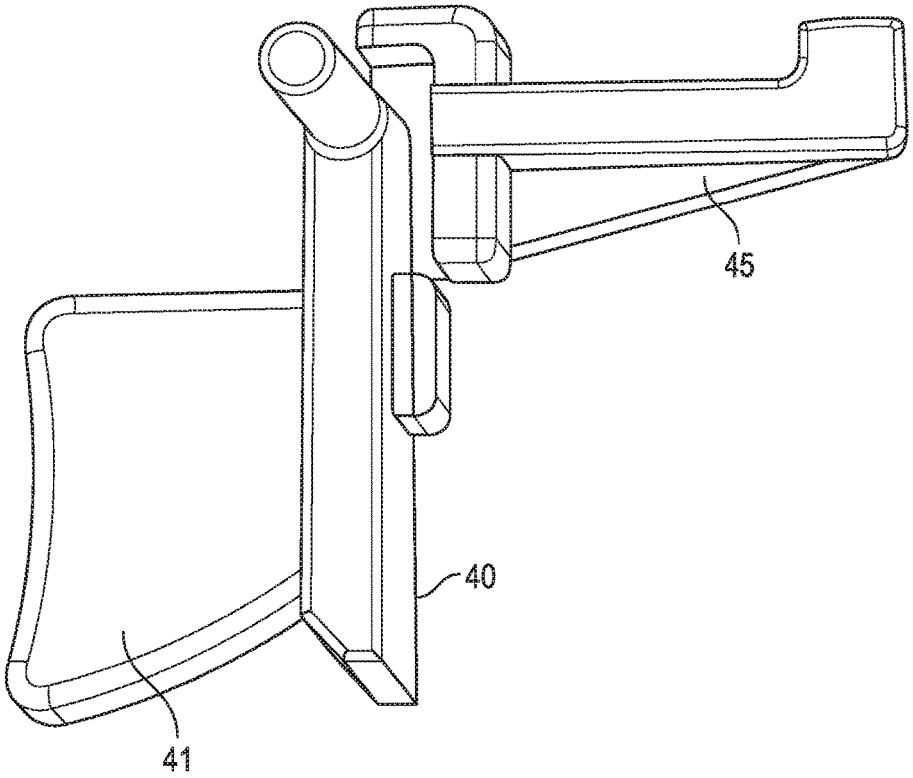
FIG. 5 is an exploded view of the trigger of the sensory enhancement system according to preferred embodiment of the invention.
Figure 6:
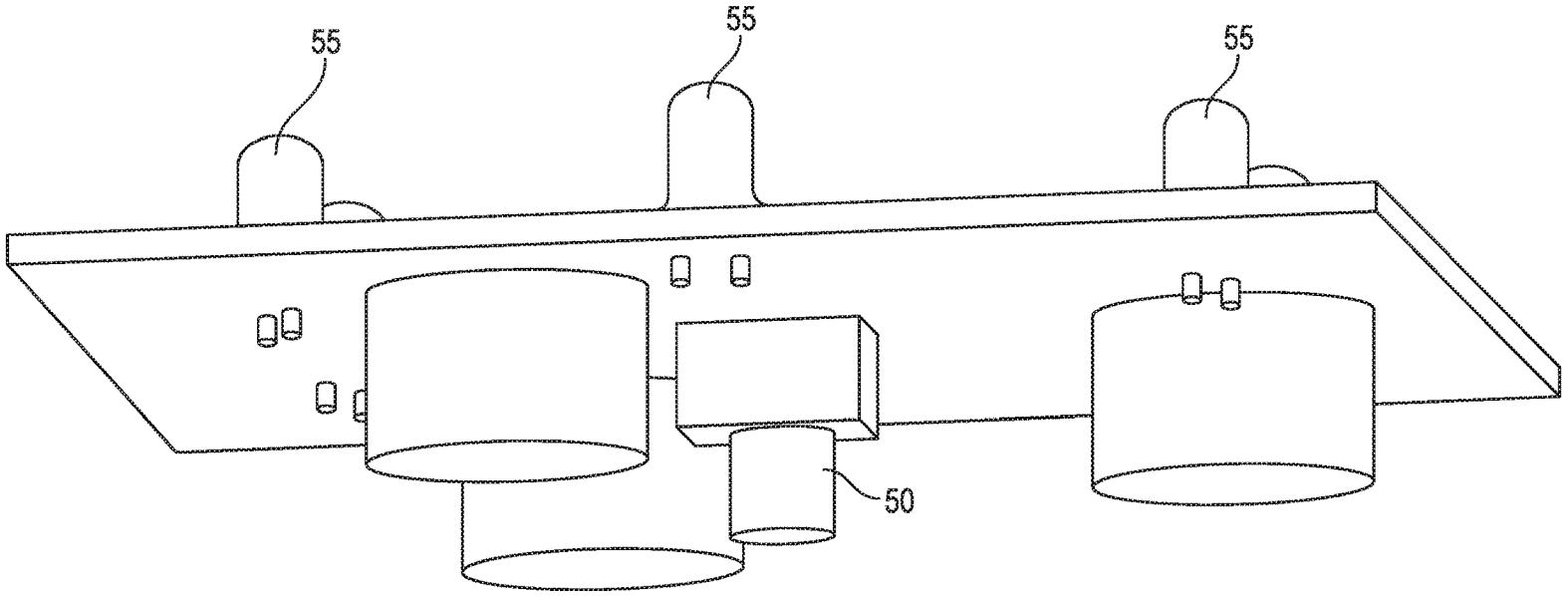
FIG. 6 is an exploded view of the system housing of the sensory enhancement system according to preferred embodiment of the invention.

As seen in FIGS. 4-5, a trigger assembly 40 which includes a finger guide 41 over the switch to allow greater flexibility in manipulation and user control may also be included. Other mechanisms which allow controlled start and stopping of flashing sequence of the sensory enhancement system and rapid dispensing of multiple bills toward a target may additionally be used. Other assemblies beside the switch or trigger 40 which enable the completion of the electrical circuit may be used. Alternatively, a remote device may be coupled wirelessly with the sensory enhancement system and handheld projectile dispenser to allow for remote operation, thus improving the functionality, novelty or overall use of the device for its intended purposes. Increased and prolonged depression of the switch or trigger increases and sustains the flashing sequence of the sensory enhancement system. When the user releases or turns off the switch mechanism, the guide arm 45, disengages the electrical circuit of the system housing 50 and flashing sequence ceases. The sensory enhancement system may be configured to operate with or without dispensing of stacked materials in the handheld projectile dispenser.

The sensory enhancement system of the handheld projectile dispenser features an electrical circuit, which consists of a switch mechanism (push-button, trigger or other actuation means) that closes the circuit, a battery power source 21, and a plurality of spaced apart light-emitting diodes (LEDs) 55. This simple electrical circuit or more complex variations thereof may be used. For example, an intensity control element such as a potentiometer may be added to further control the intensity of the brightness of the LEDs 55.

Alternatively, the power source can also be located outside the base 15 and handle 40 of the device as long it can generate the electricity to power the motor. The battery compartment cover of the handle can be omitted in an alternate construction of the handle if a removable, rechargeable battery pack configured as a handle that can be attached to the base is also used.

In operation, the handheld projectile dispenser allows the users to load a stack of paper, dollar bills, coupons, promotional flyers and the like into the storage compartment of the base 15. The upper panel 31*a* is closed and depending on the number of bills inserted, is engaged in direct contact with the surface of the stack of bills. Engagement of the trigger closes the electrical circuit between the battery power source 21 and the motor, and initiates the flow of electricity from the battery 21 to the housing of the sensory enhancement system. The electric impulses also begin the rotation of the motor, which in turn effectuates the dispensing of bills in conjunction with the flashing sequence of the LEDs 55 in the sensory enhancement system that rapidly and successively turn on and off in a manner similar to lights on a police vehicle.

Various audio features can be added to sensory enhancement system to enhance the excitement of the action of the handheld projectile dispenser by generating one or more sounds upon activation of the power source. Colors, branding and logos can also be added on the exterior surfaces, and the external shape of the device can be conformed to resemble various objects, characters and figures.

The invention claimed is:

1. A sensory enhancement system for a handheld projectile dispenser comprising:

a system housing;

a plurality of light emitting diodes;

a sound generator;

a power source;

an electrical circuit;

a trigger assembly;

the plurality of light emitting diodes, the sound generator, the power source and the electrical circuit being disposed on the system housing;

the trigger assembly being pivotally disposed on the system housing;

each of the plurality of light emitting diodes being electrically coupled with the electrical circuit;

the sound generator being electrically coupled with the electrical circuit;

the power source being electrically coupled with the electrical circuit;

the power source being configured to provide an electricity flow through the electrical circuit to the plurality of light emitting diodes;

the power source being configured to provide another electricity flow through the electrical circuit to the sound generator;

the trigger assembly being configured to selectively activate and inactivate the plurality of light-emitting diodes;

the trigger assembly being configured to selectively activate and inactivate the sound generator;

the electrical circuit comprising a switch;

the switch being configured to selectively open and close the electrical circuit;

the trigger assembly comprising a shaft and a guide arm;

the shaft and the guide arm being connected with each other;

the shaft being pivotally connected with the system housing;

the guide arm and the switch being located adjacent to each other;

the guide arm being configured to be selectively engaged and disengaged with the switch;

in response to the guide arm being engaged with the switch, the switch closing the electrical circuit;

in response to the switch closing the electrical circuit, the electricity flow provided by the power source flowing through the electrical circuit to the plurality of light emitting diodes;

in response to the electricity flow flowing to the plurality of light emitting diodes, the plurality of light-emitting diodes being activated;

in response to the switch closing the electrical circuit, the another electricity flow provided by the power source flowing through the electrical circuit to the sound generator;

in response to the another electricity flowing to the sound generator, the sound generator being activated;

in response to the guide arm being disengaged with the switch, the switch opening the electrical circuit;

in response to the switch opening the electrical circuit, the electricity flow provided by the power source being prevented from flowing through the electrical circuit to the plurality of light emitting diodes;

in response to the electricity flow being prevented from flowing to the plurality of light emitting diodes, the plurality of light-emitting diodes being inactivated;

in response to the switch opening the electrical circuit, the another electricity flow provided by the power source being prevented from flowing through the electrical circuit to the sound generator; and in response to the another electricity being prevented from flowing to the sound generator, the sound generator being inactivated.

* * * * *